US011066938B2

(12) United States Patent
Umehara et al.

(10) Patent No.: US 11,066,938 B2
(45) Date of Patent: Jul. 20, 2021

(54) ROTARY MACHINE

(71) Applicant: MITSUBISHI HEAVY INDUSTRIES, LTD., Tokyo (JP)

(72) Inventors: Ryuichi Umehara, Tokyo (JP); Haruko Shiraishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/361,753

(22) Filed: Mar. 22, 2019

(65) Prior Publication Data

US 2019/0301289 A1 Oct. 3, 2019

(30) Foreign Application Priority Data

Mar. 28, 2018 (JP) ..... JP2018-062690

(51) Int. Cl.
*F01D 5/22* (2006.01)

(52) U.S. Cl.
CPC ..... *F01D 5/22* (2013.01); *F05D 2240/30* (2013.01); *F05D 2240/80* (2013.01); *F05D 2250/294* (2013.01); *F05D 2260/30* (2013.01)

(58) Field of Classification Search
CPC ... F01D 5/16; F01D 5/22; F01D 25/06; F05D 2240/80; F05D 2260/96
See application file for complete search history.

(56) References Cited

U.S. PATENT DOCUMENTS 4,111,603 A 9/1978 Stahl
6,851,932 B2 * 2/2005 Lagrange ..... F01D 5/26 416/190
7,104,758 B2 9/2006 Brock et al.
7,534,090 B2 5/2009 Good et al.
9,194,238 B2 * 11/2015 Roberts, III ..... F01D 25/06
9,506,372 B2 * 11/2016 Schoenhoff ..... F01D 5/22
2008/0313899 A1 12/2008 Bauer et al.
2016/0333704 A1 11/2016 Annaluri et al.

FOREIGN PATENT DOCUMENTS

CN 107780973 3/2018
JP 11-13401 1/1999
JP 2009-2327 1/2009
JP 2016-217349 12/2016

* cited by examiner

*Primary Examiner* — Woody A Lee, Jr.
*Assistant Examiner* — Maxime M Adjagbe
(74) *Attorney, Agent, or Firm* — Wenderoth, Lind & Ponack, L.L.P.

(57) ABSTRACT

A rotary machine includes damper pins and platforms each having a flat surface extending in an axial line direction. For each adjacent pair of the platforms, a damper abutting surface of a first of the adjacent pair of the platforms extends toward a damper abutting surface of a second of the adjacent pair of the platforms as approaching an outer side of a rotor blade stage in a radial direction while opposing each other in a peripheral direction. A damper accommodation space, which is defined by surfaces including the damper abutting surfaces, is defined between each adjacent pair of the platforms. Each of the damper pins defines a regular polygonal prism extending in the axial line direction and includes a damper pin main body in which an angle defined by two side surfaces corresponds to an angle defined by the damper abutting surfaces between the adjacent pair of the platforms.

3 Claims, 4 Drawing Sheets

ROTARY MACHINE

CROSS-REFERENCE TO RELATED APPLICATION

Priority is claimed from Japanese Patent Application No. 2018-62690, filed on Mar. 28, 2018, the contents of which are incorporated herein by reference.

BACKGROUND OF THE INVENTION

Field of the Invention

The present relates to a rotary machine.

Description of Related Art

In rotary machines, such as gas turbines or jet engines, a configuration is known in which dampers are each installed between turbine rotor blades adjacent to each other. The damper comes into contact with the turbine rotor blade when the rotary machine rotates. In addition, when an excitation force acting on the turbine rotor blade and vibration occurs, the vibration is attenuated by a frictional force at a contact location between the damper and the turbine rotor blade.

For example, Japanese Unexamined Patent Application, First Publication No. 2016-217349 discloses a rotary machine provided with damper pins that come into contact with both of the platforms of turbine rotor blades adjacent to each other.

SUMMARY OF THE INVENTION

However, wear occurs in the damper pin due to the frictional force with a platform. In particular, in a case where the sectional shape of the damper pin is circular, since the damper pin and the platform come into line-contact with each other, a surface pressure received by the damper pin increases. Therefore, the wear on the damper pin surface is more likely to progress. When the wear of the damper pin progresses, the attenuating characteristics of the damper pin may change, and there is a case where it is not possible to apply an appropriate damper effect to the excitation force.

Considering such a situation, an object of the present invention is to provide a rotary machine which can suppress progress of wear of a damper pin.

According to a first aspect of the present invention, a rotary machine includes: a rotating shaft configured to rotate around an axial line; a plurality of rotor blades which are arranged in a peripheral direction on an outer peripheral side of the rotating shaft, and each having a blade root attached to the rotating shaft, a platform installed on an outer side of the blade root in a radial direction, and a blade main body extending to the outer side from the platform in the radial direction; and damper pins each installed on an inner side of the platform in the radial direction between the rotor blades adjacent to each other, in which the platforms are each in a shape of a flat surface extending in an axial line direction and include damper abutting surfaces extending to be close to each other as approaching the outer side in the radial direction while opposing each other in the peripheral direction in each of the platforms adjacent to each other, and in which the damper pin forms a regular polygonal prism extending in the axial line direction and includes a damper pin main body in which an angle formed by two side surfaces among a plurality of side surfaces corresponds to an angle formed by the damper abutting surfaces between the rotor blades adjacent to each other.

According to the rotary machine of the above-described aspect, when the damper pin comes into contact with the pair of damper abutting surfaces, the two side surfaces of a parent damper pin come into contact with the pair of damper abutting surfaces corresponding thereto. In other words, both of the two side surfaces of the damper pin come into contact with the pair of damper abutting surfaces in a state where a contact area is largely ensured. Therefore, compared to a case where the damper pins come into line-contact with the damper abutting surfaces, it is possible to reduce a surface pressure acting on the outer peripheral surface of the damper pin.

In addition, when the rotation of the rotary machine is stopped and the centrifugal force disappears, the damper pin is separated from the damper abutting surface. In addition, when the centrifugal force is applied again, any two side surfaces of the damper pin having a regular polygonal prism shape come into contact with the pair of damper abutting surfaces corresponding thereto. In other words, since the side surface of the damper pin on which the frictional force acts changes with each start and stop of the rotary machine, it is possible to apply attenuation by using not only the specific side surface of the damper pin but also each of the side surfaces. Therefore, it is possible to avoid only the specific side surface wearing.

In the rotary machine, the damper pin may further include a curved surface-forming portion that is provided across vertexes of both ends of the side surface on at least one of the side surfaces in a sectional view orthogonal to the axial line, and forms an outer peripheral curved surface that forms an arc shape having a larger radius of curvature than that of a circle that passes through each of the vertexes of the damper main body.

Accordingly, compared to a case where the sectional shape of the damper pin is circular, it is possible to increase the contact area when the damper pin comes into contact with the damper abutting surface. Therefore, it is possible to reduce the surface pressure acting on the damper pin, and it is possible to suppress the progress of wear.

According to a second aspect of the present invention, a rotary machine includes: a rotating shaft configured to rotate around an axial line; a plurality of rotor blades which are arranged in a peripheral direction on an outer peripheral side of the rotating shaft, and each having a blade root attached to the rotating shaft, a platform installed on an outer side of the blade root in a radial direction, and a blade main body extending to the outer side from the platform in the radial direction; and damper pins each installed on an inner side of the platform in the radial direction between the rotor blades adjacent to each other, in which the platforms are each in a shape of a flat surface extending in an axial line direction and include damper abutting surfaces extending to be close to each other as approaching the outer side in the radial direction while opposing each other in the peripheral direction in each of the platforms adjacent to each other, and in which the damper pins uniformly extend in the axial line direction and each having an outline having a sectional shape orthogonal to the axial line, which forms a non-rotationally symmetrical shape.

When the rotation of the rotary machine stops and the centrifugal force disappears, the damper pin is separated from the damper abutting surface, and then, when the rotary machine rotates and the centrifugal force acts on the damper pin, the damper pin comes into contact with the damper abutting surface again. Here, in the present aspect, since the outline having a sectional shape of the damper pin has a non-rotationally symmetrical shape, the position of the outer peripheral surface when the damper pin comes into contact with the damper abutting surface again is randomly determined. Accordingly, it is possible to suppress the progress of the wear only at a specific location as only the specific location of the outer peripheral surface of the damper pin comes into contact with the damper abutting surface.

Furthermore, as each of the damper pins disposed at different locations randomly comes into contact with the damper abutting surfaces, attenuation aspects in each of the damper pins become different from each other. Accordingly, it is possible to apply the attenuation to a wide range of excitation force as a whole of the rotary machine.

Furthermore, since the contact location on the damper abutting surface also changes, it is also possible to suppress the wear on the platform side.

In the rotary machine according to the aspect, in the damper pin, the outline having a sectional shape orthogonal to the axial line may be formed of a plurality of arcs which are convex outward and have radiuses of curvature different from each other, and a plurality of line segments that connect the arcs to each other.

Accordingly, the outline of the outer peripheral surface of the damper pin has a non-rotationally symmetrical shape, and it is possible to randomly change the contact location of the damper pin. Since the region where the outline is a line segment has a shape of a flat surface, it is also possible to reduce the surface pressure.

According to the rotary machine of the present invention, it is possible to suppress the progress of wear of the damper pin.

DETAILED DESCRIPTION OF THE INVENTION

First Embodiment

Hereinafter, a gas turbine 1 according to a first embodiment of the present invention will be described with reference to FIGS. 1 to 3.

Figure 1:
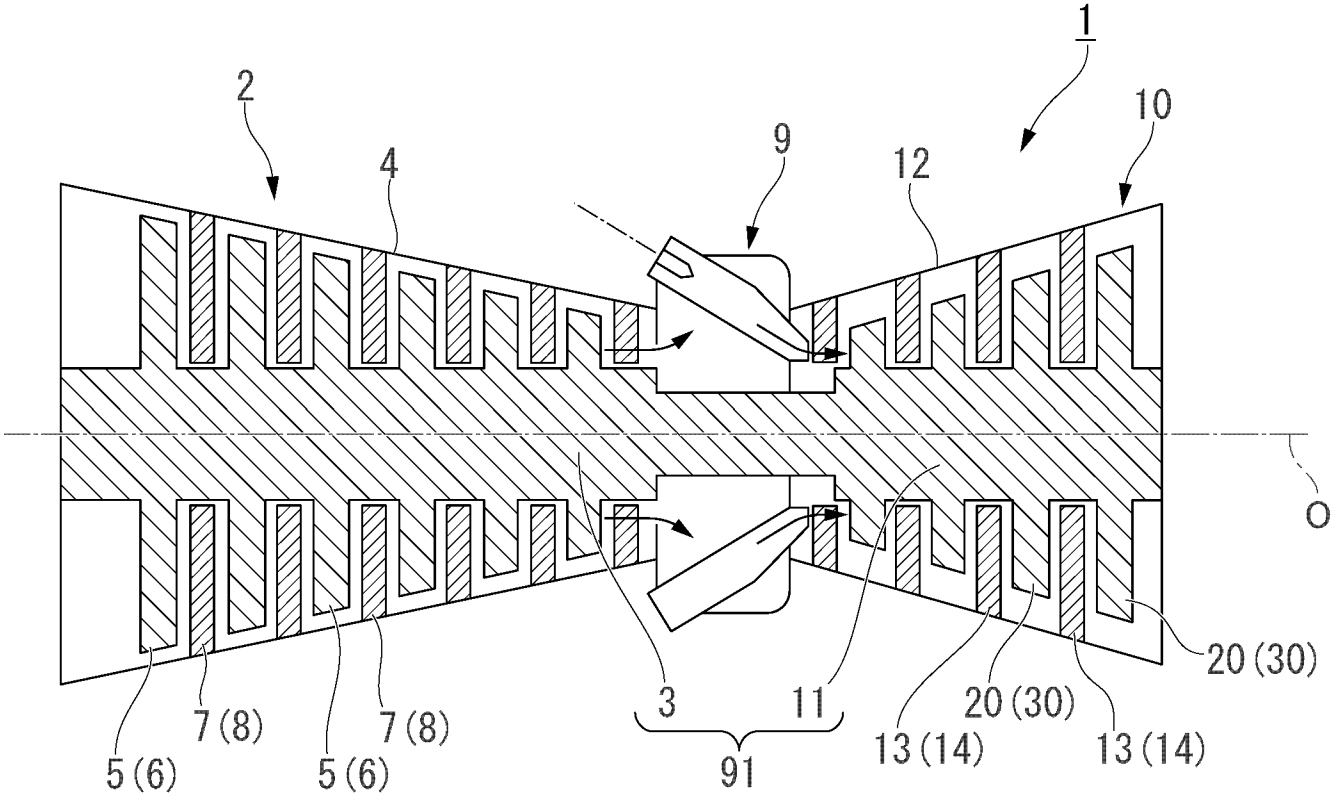
FIG. 1 is a schematic vertical sectional view of a gas turbine according to a first embodiment.

As illustrated in FIG. 1, the gas turbine 1 according to the present embodiment includes a compressor 2 that generates compressed air, a combustor 9 that generates combustion gas by mixing and combusting fuel with the compressed air, and a turbine 10 that is driven by the combustion gas.

The compressor 2 includes a compressor rotor 3 configured to rotate around an axial line O, and a compressor casing 4 that covers the compressor rotor 3 from an outer peripheral side. The compressor rotor 3 has a columnar shape extending along the axial line O. A plurality of compressor rotor blade stages 5 arranged at intervals in an axial line O direction are installed on an outer peripheral surface of the compressor rotor 3. Each of the compressor rotor blade stages 5 includes a plurality of compressor rotor blades 6 arranged at intervals in a peripheral direction of the axial line O on the outer peripheral surface of the compressor rotor 3.

The compressor casing 4 has a cylindrical shape around the axial line O. A plurality of compressor stationary blade stages 7 arranged at intervals in the axial line O direction are installed on an inner peripheral surface of the compressor casing 4. The compressor stationary blade stages 7 are alternately arranged with respect to the compressor rotor blade stages 5 when viewed from the axial line O direction. Each of the compressor stationary blade stages 7 includes a plurality of compressor stationary blades 8 arranged at intervals in the peripheral direction of the axial line O on the inner peripheral surface of the compressor casing 4.

The combustor 9 is installed between the compressor casing 4 and a turbine casing 12 which will be described later. The compressed air generated by the compressor 2 is mixed with a fuel on the inside of the combustor 9 to become a premixed gas. In the combustor 9, the combustion gas having a high temperature and a high pressure is generated by combusting the premixed gas. The combustion gas is introduced into the turbine casing 12 to drive the turbine 10.

The turbine 10 includes a turbine rotor 11 configured to rotate around the axial line O, and the turbine casing 12 that covers the turbine rotor 11 from the outer peripheral side. The turbine rotor 11 has a columnar shape extending along the axial line O. A plurality of turbine rotor blade stages 20 arranged at intervals in the axial line O direction are formed on an outer peripheral surface of the turbine rotor 11. Each of the turbine rotor blade stages 20 includes a plurality of turbine rotor blades 30 arranged at intervals in the peripheral direction of the axial line O on the outer peripheral surface of the turbine rotor 11. The turbine rotor 11 is integrally connected to the compressor rotor 3 in the axial line O direction to form the gas turbine rotor.

The turbine casing 12 has a cylindrical shape around the axial line O. A plurality of turbine stationary blade stages 13 arranged at intervals in the axial line O direction are formed on an inner peripheral surface of the turbine casing 12. The turbine stationary blade stages 13 are alternately arranged with respect to the turbine rotor blade stages 20 when viewed from the axial line O direction. Each of the turbine stationary blade stages 13 includes a plurality of turbine stationary blades 14 arranged at intervals in the peripheral direction of the axial line O on the inner peripheral surface of the turbine casing 12. The turbine casing 12 is connected to the compressor casing 4 in the axial line O direction to form the gas turbine casing. In other words, the gas turbine rotor is integrally rotatable around the axial line O in the gas turbine casing.

Turbine Rotor Blade

Next, the turbine rotor blade 30 will be described in more detail with reference to FIG. 2.

The turbine rotor blade 30 has a blade root 31, a platform 32, and a blade main body 41.

The blade root 31 is a part attached to the turbine rotor 11 in the turbine rotor blade 30. The turbine rotor 11 is configured by stacking a plurality of disk-like disks 11*a* around the axial line O in the axial line O direction. The blade root 31 is integrally attached to the disk 11*a* by being inserted from the axial line O direction into a recessed groove (not illustrated) of the disk 11*a* formed on the outer peripheral surface of the disk 11*a*. Accordingly, the turbine rotor blades 30 are radially disposed at intervals in the peripheral direction with respect to the disk 11*a*.

The platform 32 is integrally formed on the outer side of the blade root 31 in the radial direction. The platform 32 projects from an end portion on the outer side of the blade root 31 in the radial direction in the axial line O direction and in the peripheral direction. An outer peripheral surface 33 that faces the outer side in the platform 32 in the radial direction is exposed to the combustion gas that passes through the turbine 10.

A platform side surface 34 that faces the peripheral direction in the platform 32 extends in the radial direction and in the axial line O direction. The platform side surfaces 34 oppose each other in the peripheral direction between the platforms 32 of the turbine rotor blades 30 adjacent to each other.

On the platform side surface 34, a recess portion 37 that is recessed from the platform side surface 34 and extends in the axial line O direction is formed. A damper accommodation space R1 extending so as to penetrate the platform 32 in the axial line O direction according to the shape of the recess portion 37 is defined by the recess portions 37 of the platforms 32 adjacent to each other. The damper accommodation space R1 is formed between all of the platforms 32 adjacent to each other. Therefore, the same number of damper accommodation spaces R1 are formed as that of the turbine rotor blades 30.

Each of the platform side surfaces 34 is divided by the recess portion 37 in the radial direction. On the platform side surface 34, a part on the outer side of the recess portion 37 in the radial direction is an outer peripheral side surface 35, and a part on the inner side of the recess portion 37 in the radial direction is an inner peripheral side surface 36.

Figure 2:
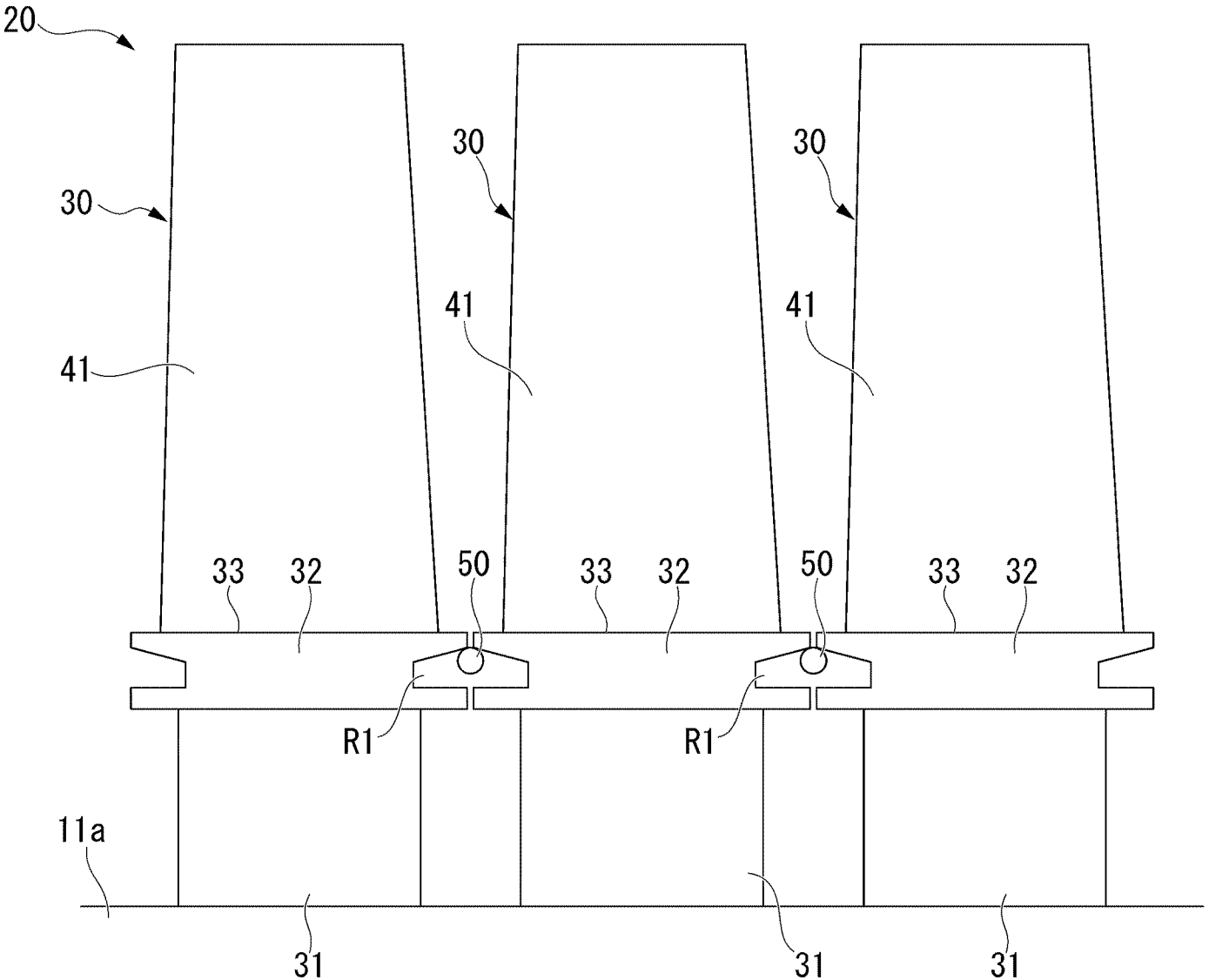
FIG. 2 is a schematic view of a rotor blade group of the gas turbine according to the first embodiment when viewed from an axial line direction.
Figure 3:
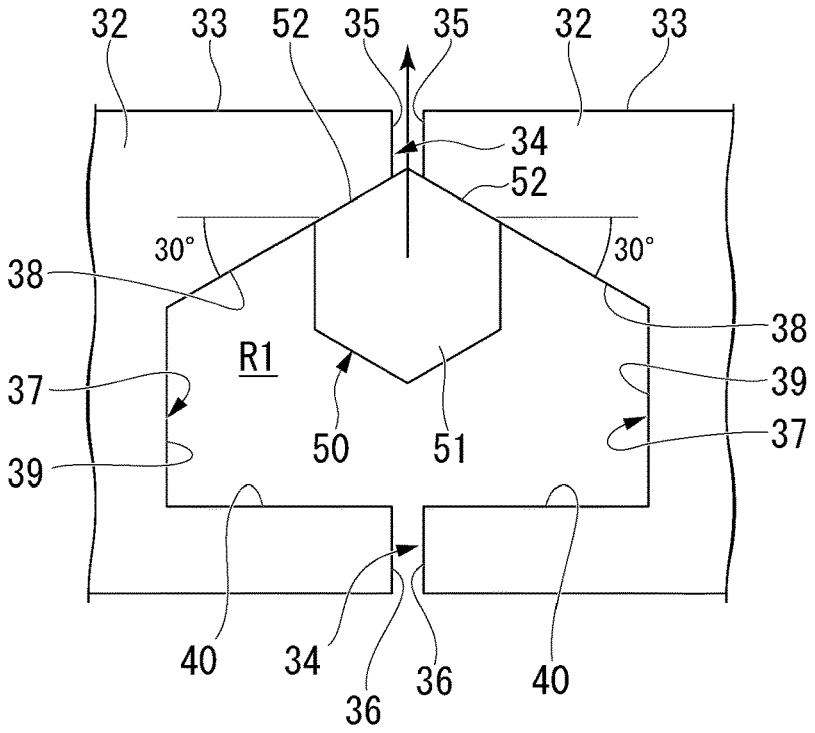
FIG. 3 is an enlarged view of an essential part of FIG. 2 and is a view of platforms adjacent to each other of the gas turbine according to the first embodiment when viewed from the axial line direction.

As illustrated in FIG. 2 and FIG. 3, a surface that faces the inner side in the recess portion 37 of the platform 32 in the radial direction is a damper abutting surface 38. The damper abutting surface 38 is in a shape of a flat surface parallel to the axial line O. The damper abutting surface 38 extends being inclined toward the outer side in the peripheral direction as approaching the outer side of each of the turbine rotor blades 30 in the radial direction, and is connected to the outer peripheral side surface 35 of the platform 32.

The damper abutting surfaces 38 of the platforms 32 adjacent to each other oppose each other in the peripheral direction. The damper abutting surfaces 38 are inclined such that an opposing distance becomes shorter as approaching the outer side in the radial direction. The pair of damper abutting surfaces 38 are disposed in line symmetry with a straight line along the radial direction when viewed in the axial line O direction as a target axis.

As illustrated in FIG. 3, the end portion on the side opposite to the outer peripheral side surface 35 in the damper abutting surface 38 is connected to the end portion on the outer side of a recess portion bottom surface 39 in the radial direction that is parallel to the axial line O and extends in the radial direction. Between the end portion on the inner side in the radial direction and the end portion on the outer side of the inner peripheral side surface 36 in the radial direction in the recess portion bottom surface 39, a recess portion lower surface 40 that is parallel to the axial line O and extends in the peripheral direction is formed. The damper accommodation space R1 is defined by the damper abutting surface 38, the recess portion bottom surface 39, and the recess portion lower surface 40 of the platforms 32 adjacent to each other.

The blade main body 41 extends toward the outer side in the radial direction from the outer peripheral surface 33 of the platform 32. In other words, a base end of the blade main body 41 is integrally connected to the end portion on the outer side of the platform 32 in the radial direction. The blade main body 41 has a blade-shaped sectional shape orthogonal to an extending direction of the blade main body 41.

Damper Pin

As illustrated in FIGS. 2 and 3, the damper pins 50 are accommodated in each of the damper accommodation spaces R1. In other words, the same number of damper pins 50 are installed as that of the damper accommodation spaces R1 corresponding to the damper accommodation spaces R1. The damper pin 50 has a pin-like damper pin main body 51 extending in the axial line O direction. In the damper pin 50, a sectional shape orthogonal to the axial line O is uniformly made in the axial line O direction.

In the damper pin main body 51, the sectional shape orthogonal to the axial line O is a regular polygonal shape. In other words, the damper pin main body 51 is in a regular polygonal columnar shape. In the present embodiment, in the damper pin main body 51, the sectional shape orthogonal to the axial line O is a regular hexagonal shape. Therefore, the damper pin main body 51 has six side surfaces 52 having the same rectangular shape. An angle formed between the pair of side surfaces 52 adjacent to each other is set to 120°. The distance between the side surfaces 52 that face the side opposite to each other in the damper pin main body 51 is set to be larger than the distance between the pair of platform side surfaces 52, that is, the distance between the pair of outer peripheral side surfaces 35. In other words, a dimension (a diameter of an inscribed circle of the outline of the section orthogonal to the axial line O of the damper pin main body 51) of the smallest outer diameter among the outer diameters of the damper pin main body 51 is set to be larger than the interval between the pair of outer peripheral side surfaces 35.

Corresponding to the shape of the damper pin main body 51, an angle formed by the pair of damper abutting surfaces 38 that defines the damper accommodation space R1 in which the damper pin main body 51 is accommodated is set to be the same as an angle formed by the side surfaces 52 adjacent to each other in the damper pin main body 51. Accordingly, in the present embodiment, the angle formed by the pair of damper abutting surfaces 38 is set to 120°. In this case, an inclination angle of the damper abutting surface 38 is set to 30°.

In other words, the angle formed by the two side surfaces 52 adjacent to each other among the plurality of side surfaces 52 of the damper pin main body 51 corresponds to the angle formed by the pair of damper abutting surfaces 38.

Functional Effect

When the turbine 10 rotates, the centrifugal force is generated on the damper pin 50, and the side surfaces 52 of the damper pins 50 each come into contact with the damper abutting surfaces 38 of the pair of platforms 32. In the present embodiment, the angle formed by the side surfaces 52 adjacent to each other of the damper pin 50 corresponds to the angle formed by the pair of damper abutting surfaces 38. Therefore, the pair of side surfaces 52 adjacent to each other in the damper pin 50 comes into contact with the pair of damper abutting surfaces 38 in a one-to-one correspondence. In other words, both of the two side surfaces 52 of the damper pin 50 come into contact with the pair of damper abutting surfaces 38 in a state where the contact area is largely ensured.

Here, for example, in a case where the outline of the sectional shape of the damper pin 50 is circular, the damper pin 50 comes into line-contact with the damper abutting surface 38. Therefore, as a result of the large action of the surface pressure on the damper pin 50, the wear of the damper pin 50 progresses early.

In addition, even when the outline of the sectional shape of the damper pin 50 is in a polygonal shape, when the angle of the damper abutting surface 38 is not set to correspond thereto, a corner portion of the sectional shape of the damper pin 50 comes into contact with the damper abutting surface, and the wear of both of the damper pin 50 and the damper abutting surface 38 is promoted.

In the present embodiment, since the two side surfaces 52 of the damper pin main body 51 preferably come into surface-contact with the damper abutting surface 38, it is possible to reduce the surface pressure acting on the outer peripheral surface of the damper pin main body 51. Accordingly, it is possible to suppress the early progress of the wear of the outer peripheral surface of the damper pin main body 51.

In addition, when the rotation of the turbine 10 is stopped and the centrifugal force disappears, the damper pin 50 is separated from the damper abutting surface 38. In addition, when the turbine 10 rotates and the centrifugal force is applied again, the two side surfaces 52 adjacent to each other in the damper pin main body 51 having a regular polygonal prism shape come into contact with the pair of damper abutting surfaces 38 corresponding thereto. In other words, since the side surface 52 of the damper pin 50 on which the frictional force acts changes with each start and stop of the turbine 10, it is possible to apply attenuation by using not only the specific side surface 52 of the damper pin 50 but also each of the side surfaces 52. Therefore, it is possible to avoid only the specific side surface 52 wearing. In other words, it is possible to suppress the progress of wear of the damper pin 50 as a whole.

Figure 4:
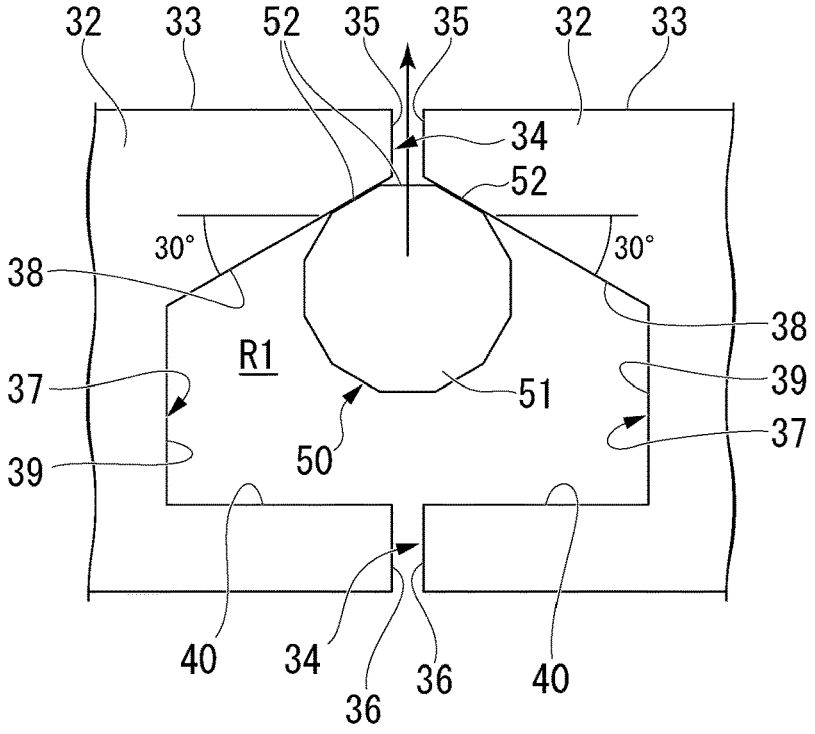
FIG. 4 is a view of a damper pin according to a modification example of the first embodiment when viewed from the axial line direction.

Here, as a modification example of the first embodiment, as illustrated in FIG. 4, for example, a sectional shape orthogonal to the axial line O of the damper pin main body 51 may be a dodecagonal shape. In this case, among the twelve side surfaces 52 of the damper pin main body 51, the pair of side surfaces 52 on both sides of the certain side surface 52 comes into contact with the damper abutting surface 38. In other words, two side surfaces 52 with one side surface 52 interposed therebetween come into contact with the damper abutting surface 38. Accordingly, similar to the above-described embodiment, it is possible to suppress the progress of wear of the damper pin 50.

In addition, the damper pin 50 is not limited to the configuration as long as the shape is a regular polygonal prism shape.

For example, the outline of the sectional shape orthogonal to the axial line O of the damper pin 50 may have a regular nonagonal shape or a regular octadecagonal shape. In this case, the inclination angle of the pair of damper abutting surfaces 38 is set to 20° or 40°. For example, the outline of the sectional shape orthogonal to the axial line O of the damper pin 50 may have a square shape, a regular octagonal shape, or a regular hexadecagonal shape. In this case, the angle formed by the pair of damper abutting surfaces 38 is set to 45°. In addition, the outline of the sectional shape orthogonal to the axial line O of the damper pin 50 may have a regular icosikaitetragonal shape. In this case, the angle formed by the pair of damper abutting surfaces 38 is set to 30°.

In other words, the damper pin 50 may be in a regular polygonal shape, and the angle formed by the pair of damper abutting surfaces 38 may correspond to the angle formed by any two side surfaces 52 among the plurality of damper pins 50. Accordingly, since any two side surfaces 52 of the damper pin 50 simultaneously come into surface-contact with the damper abutting surface 38, it is possible to suppress the wear of the damper pin 50.

Second Embodiment

Figure 5:
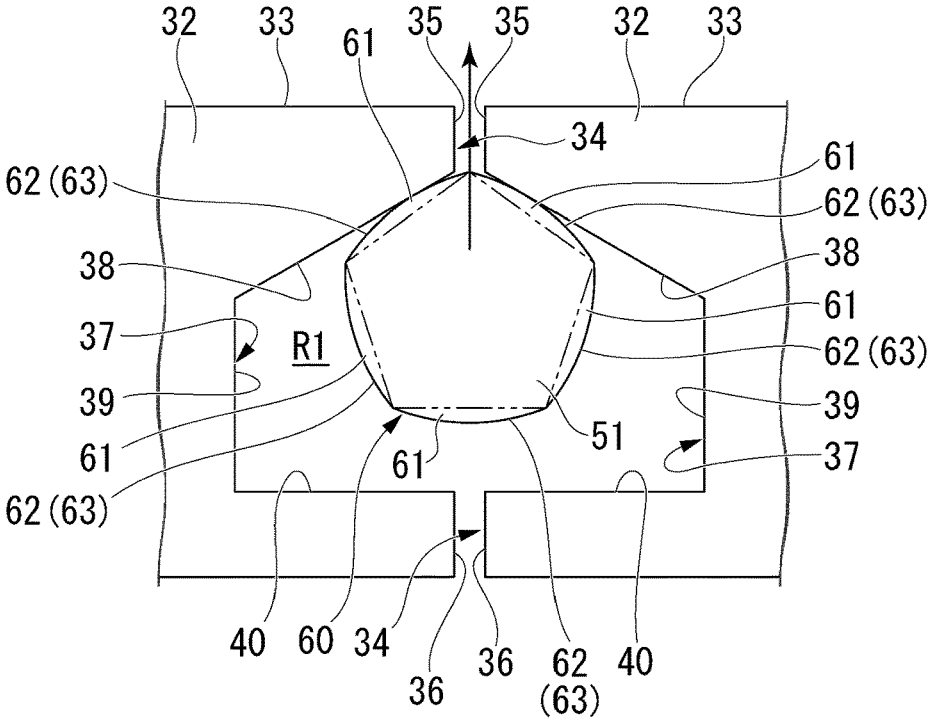
FIG. 5 is a view of a damper pin of a gas turbine according to a second embodiment when viewed from the axial line direction.

Next, a second embodiment of the present invention will be described with reference to FIG. 5. In the second embodiment, the same configuration elements as those of the first embodiment will be denoted by the same reference numerals, and the detailed description thereof will be omitted.

A damper pin 60 of the second embodiment includes a curved surface-forming portion 61 in addition to the damper pin main body 51 similar to the first embodiment.

The curved surface-forming portion 61 is integrally formed on each of the side surfaces 52 of the damper pin main body 51. The curved surface-forming portion 61 is formed over the entire region of each of the side surfaces 52. The curved surface-forming portion 61 has an arc-shaped outline extending across vertexes of both ends of the side surface 52 in a sectional view orthogonal to the axial line O. An arc 62 of the curved surface-forming portion 61 is the arc 62 which is convex on the outer peripheral side of the damper pin 60. The arc 62 of the curved surface-forming portion 61 has a radius of curvature larger than a radius of curvature of a reference circle (a circumscribed circle of the damper pin main body 51) that passes through each of the vertexes when viewed from a section orthogonal to the axial line O of the damper pin main body 51. Accordingly, the outline of the sectional shape orthogonal to the axial line O of the damper pin 60 has a shape in which a plurality (six in the present embodiment) of arcs 62 are combined with each other. Each of the arcs 62 adjacent to each other is connected to each other at the vertex of the damper pin main body 51.

Accordingly, on the side surface 52 of the damper pin 60, an outer peripheral curved surface 63 having the same radius of curvature as that of the arc 62 is formed. The outer peripheral surface of the damper pin 60 has a configuration in which a plurality of outer peripheral curved surfaces 63 are combined with each other. A ridge line extending in the axial line O direction is formed between the outer peripheral curved surfaces 63 adjacent each other. In other words, the outer peripheral curved surfaces 63 adjacent to each other are connected to each other in the axial line O direction via the ridge line.

Functional Effect

According to the configuration, in addition to the functional effect of the first embodiment, compared to a case where the sectional shape of the damper pin 60 is circular, it is possible to increase the contact area when the damper pin 60 comes into contact with the damper abutting surface. Therefore, it is possible to reduce the surface pressure acting on the damper pin 60, and it is possible to suppress the progress of wear.

In addition, in the configuration, an example in which the curved surface-forming portion 61 is formed on all of the side surfaces 52 of the damper pin main body 51 has been described, but the curved surface-forming portion 61 may be formed on at least one side surface 52 among the plurality of side surfaces 52.

Third Embodiment

Next, a third embodiment of the present invention will be described with reference to FIG. 6. In the third embodiment, the same configuration elements as those of the first embodiment will be denoted by the same reference numerals, and the detailed description thereof will be omitted.

A damper pin 70 of the present embodiment extends in a uniform shape in the axial line O direction. The outline of the sectional shape orthogonal to the axial line O of the damper pin 70 has a non-rotationally symmetrical shape.

In the present embodiment, the outline shape orthogonal to the axial line O of the damper pin 70 may be formed of a plurality of arcs 71 which are convex outward and have radiuses of curvature different from each other, and a plurality of line segments 72 that connect the arcs 71 to each other, as an example of the non-rotationally symmetrical shape.

Accordingly, the outline shape of the damper pin 70 has a non-rotationally symmetrical shape in which the same shape that overlaps the outline shape does not appear even when a part of the outline shape is rotated around any rotating shaft line.

Functional Effect

In the present embodiment, since the outline having a sectional shape of the damper pin 70 has a non-rotationally symmetrical shape, when the start and stop of the turbine 10 is repeated, the position of the outer peripheral surface when the damper pin 70 comes into contact with the damper abutting surface 38 again is randomly determined. Accordingly, it is possible to suppress the progress of the wear only at a specific location as only the specific location of the outer peripheral surface of the damper pin 70 comes into contact with the damper abutting surface 38. Furthermore, since the contact location of the damper pin 70 on the damper abutting surface 38 also changes, it is also possible to suppress the wear on the platform side.

Furthermore, as each of the damper pins 70 disposed at different locations randomly comes into contact with the damper abutting surfaces 38, attenuation aspects in each of the damper pins 70 become different from each other. Accordingly, it is possible to apply the attenuation effect to a wide range of excitation force as a whole of the turbine 10.

In particular, by forming the outline of the sectional shape orthogonal to the axial line O of the damper pin 70 from the different arcs 71 and line segments 72, it is possible to easily set the outline of the outer peripheral surface of the damper pin 70 to have a non-rotationally symmetrical shape. Accordingly, it is possible to more randomly change the contact location of the damper pin 70. In addition, since the region of the line segment 72 of the outline has a shape of a flat surface, it is possible to reduce the surface pressure by being in surface-contact with the damper abutting surface.

In addition, weight adjustment of the damper pin 70 may be performed by forming holes or hollow portions in the damper pin 70, for example, such that the contact locations of the damper pin 70 with the damper abutting surface 38 become more random.

Figure 6:
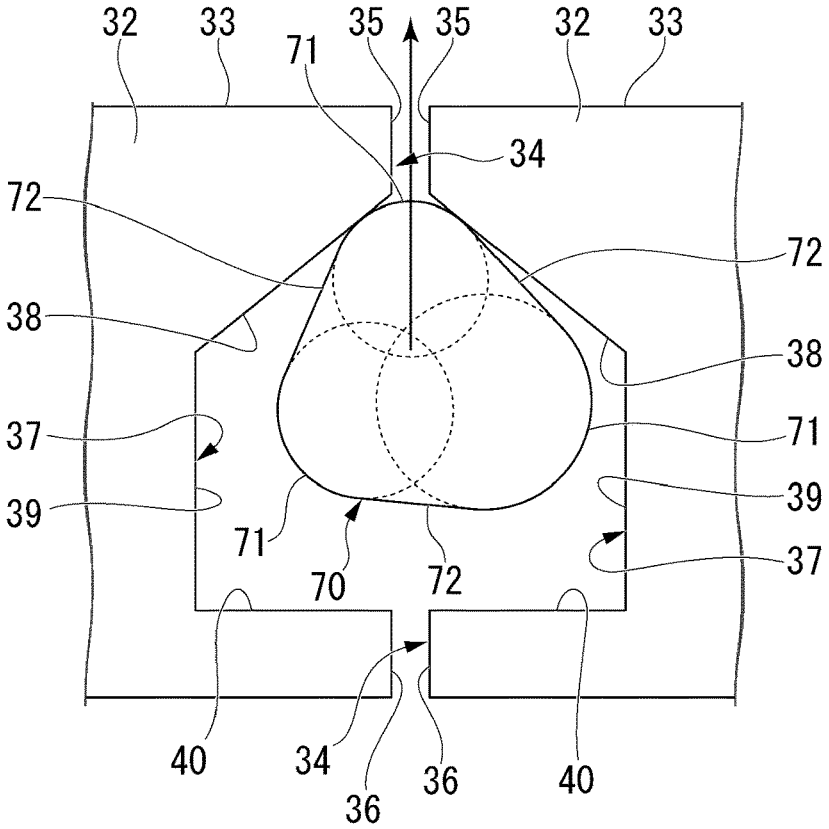
FIG. 6 is a view of a damper pin of a gas turbine according to a third embodiment when viewed from the axial line direction.

Moreover, the damper pin 70 is not limited to the sectional shape illustrated in FIG. 6, and may have other sectional shapes when the sectional shape is a non-rotationally symmetrical shape.

Other Embodiments

Above, although the embodiments of the present invention have been described, not being limited thereto, the present invention can be appropriately changed within the range which does not depart from the technical idea of the invention.

In addition, in the first, second, and third embodiments, an example has been described in which the pair of damper abutting surfaces 38 are disposed in line symmetry with the straight line along the radial direction when viewed in the axial line O direction as the target axis. However, not being limited thereto, for example, one of the pair of damper abutting surfaces 38 may be inclined similar to the embodiment, and the other damper abutting surface 38 may extend in the radial direction. In addition, the pair of damper abutting surfaces 38 may be inclined at angles different from each other. Further, the angle formed by the pair of damper abutting surfaces 38 may correspond to the angle formed by any two side surfaces 52 among the plurality of side surfaces 52 of the damper pin main body 51.

EXPLANATION OF REFERENCES

1 Gas turbine
2 Compressor
3 Compressor rotor
4 Compressor casing
5 Compressor rotor blade stage
6 Compressor rotor blade
7 Compressor stationary blade stage
8 Compressor stationary blade
9 Combustor
10 Turbine
11 Turbine rotor
11*a* Disk
12 Turbine casing
13 Turbine stationary blade stage
14 Turbine stationary blade
20 Turbine rotor blade stage
30 Turbine rotor blade
31 Blade root
32 Platform
33 Outer peripheral surface
34 Platform side surface
35 Outer peripheral side surface
36 Inner peripheral side surface
37 Recess portion
38 Damper abutting surface
39 Recess portion bottom surface
40 Recess portion lower surface
41 Blade main body
50 Damper pin
51 Damper pin main body
52 Side surface
60 Damper pin
61 Curved surface-forming portion
62 Arc
63 Outer peripheral curved surface
70 Damper pin
71 Arc
72 line segment
R1 Damper accommodation space
O Axial line

What is claimed is:

1. A rotary machine comprising:

a rotatable shaft configured to rotate around an axial line;

a plurality of rotor blades arranged in a peripheral direction on an outer peripheral side of the rotatable shaft, each of the plurality of rotor blades having: (i) a blade root attached to the rotatable shaft; (ii) a platform on an outer side of the blade root in a radial direction; and (iii) a blade main body extending to an outer side of a rotor blade stage from the platform in the radial direction; and damper pins, each of the damper pins being on an inner side of an adjacent pair of the platforms in the radial direction, wherein:

each of the platforms has a flat surface extending in an axial line direction;

for each adjacent pair of the platforms, a damper abutting surface of a first of the adjacent pair of the platforms extends toward a damper abutting surface of a second of the adjacent pair of the platforms as approaching the outer side of the rotor blade stage in the radial direction while opposing each other in the peripheral direction;

a damper accommodation space, which is defined by surfaces including the damper abutting surfaces, is defined between each adjacent pair of the platforms;

each of the damper pins defines a regular polygonal prism extending in the axial line direction and includes a damper pin main body in which an angle defined by two side surfaces corresponds to an angle defined by the damper abutting surfaces between the adjacent pair of the platforms; and the damper pins are respectively accommodated in the damper accommodation spaces such that each of the damper pins is rotatable 360° around a center thereof; and each of the damper pins further includes a curved surface-forming portion that is provided across vertexes of both ends of at least one of the two side surfaces in a sectional view orthogonal to the axial line, and defines an outer peripheral curved surface that has an arc shape.

2. The rotary machine according to claim 1, wherein:

the arc shape has a radius of curvature that is larger than a radius of curvature of a circle that passes through vertexes of the damper pin main body; and the outer peripheral curved surface is configured to come into contact with at least one of the damper abutting surfaces.

3. A rotary machine comprising:

a rotatable shaft configured to rotate around an axial line;

a plurality of rotor blades arranged in a peripheral direction on an outer peripheral side of the rotatable shaft, each of the plurality of rotor blades having: (i) a blade root attached to the rotatable shaft; (ii) a platform on an outer side of the blade root in a radial direction; and (iii) a blade main body extending to an outer side of a rotor blade stage from the platform in the radial direction; and damper pins, each of the damper pins being on an inner side of an adjacent pair of the platforms in the radial direction, wherein:

each of the platforms has a flat surface extending in an axial line direction;

for each adjacent pair of the platforms, a damper abutting surface of a first of the adjacent pair of the platforms extends toward a damper abutting surface of a second of the adjacent pair of the platforms as approaching the outer side of the rotor blade stage in the radial direction while opposing each other in the peripheral direction;

a damper accommodation space, which is defined by surfaces including the damper abutting surfaces, is defined between each adjacent pair of the platforms;

each of the damper pins has a column-shape uniformly extending in the axial line direction and an outline having a sectional shape orthogonal to the axial line which defines a non-rotationally symmetrical shape;

the outline is defined by a plurality of arcs which are convex outward and have radiuses of curvature that are different from each other, and a plurality of line segments that connect the arcs to each other; and the damper pins are respectively accommodated in the damper accommodation spaces such that each of the damper pins is rotatable 360° around a center thereof.

* * * * *